United States Patent [19]

Delahousse et al.

[11] Patent Number: 4,514,885

[45] Date of Patent: May 7, 1985

[54] CLIP WITH TWO STABLE POSITIONS OF THE CLOTHES PIN TYPE

[76] Inventors: Régis Delahousse, Princé ; Philippe Delahousse, 33 Rte. de Nantes, both of Murs Erigné 49130, France

[21] Appl. No.: 579,191

[22] Filed: Feb. 10, 1984

[30] Foreign Application Priority Data

Feb. 14, 1983 [FR] France ..... 83 02540

[51] Int. Cl.[3] ..... E05D 7/00; D06F 55/02

[52] U.S. Cl. ..... 24/557; 24/489; 24/543; 24/562

[58] Field of Search ..... 24/577, 542, 346, 489, 24/506, 347, 562, 543, 72.5

[56] References Cited

U.S. PATENT DOCUMENTS

| | | | |
|---|---|---|---|
| 2,471,141 | 5/1949 | Castelli | 24/562 |
| 2,591,477 | 4/1952 | Tegarty | 24/557 |
| 3,616,497 | 11/1971 | Esposito, Jr. | 24/72.5 |
| 3,720,979 | 3/1973 | Krawagna | 24/489 |
| 3,733,656 | 5/1973 | Stalder | 24/557 |
| 4,071,930 | 2/1978 | Tanaka | 24/543 |

FOREIGN PATENT DOCUMENTS

| | | | |
|---|---|---|---|
| 0075761 | 4/1983 | European Pat. Off. . | |
| 1241572 | 6/1967 | Fed. Rep. of Germany | 24/557 |
| 1997712 | 10/1968 | Fed. Rep. of Germany . | |
| 1356257 | 2/1964 | France . | |
| 1402900 | 5/1965 | France . | |
| 1473457 | 2/1967 | France . | |
| 1590332 | 5/1970 | France . | |
| 165200 | 11/1958 | Sweden | 24/557 |
| 207775 | 10/1966 | Sweden | 24/557 |
| 1080755 | 8/1967 | United Kingdom | 24/557 |
| 1486831 | 9/1977 | United Kingdom | 24/557 |
| 1559908 | 1/1980 | United Kingdom | 24/557 |

*Primary Examiner*—Victor N. Sakran

*Attorney, Agent, or Firm*—Berman, Aisenberg & Platt

[57] ABSTRACT

The invention relates to a clip made of plastic, in one piece, consisting of two articulated arms (1,2), one of the ends (4) of which serves as jaws and the other end (5) as a lever arm, and of an upper elastic component (10) forming a spring, which comprises, between the two arms (1,2) and the elastic component (10), two swivelling, crescent-shaped components (8,9) for opening and closing the clip, which are united by a hinge (11) and joined both to the ends (5) and to the elastic component (10) by two groups of corresponding hinges (6,7,12,13).

7 Claims, 6 Drawing Figures

CLIP WITH TWO STABLE POSITIONS OF THE CLOTHES PIN TYPE

FIELD OF THE INVENTION

The present invention relates to a clip of the clothes pin type, made of plastic, in one piece, produced by injecting plastic into a mold. It relates more particularly to a clip with two stable positions: the open position on the one hand, and the closed position, on the other hand; the transition from one position to the other taking place with a sudden movement.

According to the invention the clip consists of two articulated arms one of whose ends serves as jaws, the other as a lever arm; it comprises hinges in the form of a plastic strip and components for opening and closing which ensure the holding of the jaws in an open position or a closed position.

According to a preferred arrangement, the components for opening and closing comprise on the one hand, two components swivelling under the action of a pressure on the lever arms to cause the clip to pass from the closed position into the open position or under the action of a pressure on the jaws to cause the clip to pass from the open position to the closed position, these swivelling components being united and joined to the lever arms and, on the other hand, an elastic component forming a spring. The swivelling components are crescent-shaped, joined together at one of their ends and to the lever arms at the other end, by means of hinges in the form of a strip. The elastic component is also crescent-shaped, and is joined at each end, substantially in the middle of the back, to each swivelling component, by means of hinges in the form of a strip.

DESCRIPTION OF THE PRIOR ART

Numerous embodiments of clothes pins have already been described in the prior art.

Thus, more particularly, the German Utility Model No. U 1,997,712 describes and illustrates a clip made of plastic in one piece comprising two arms joined by a hinge. Each arm is also joined, in its upper part, by a corresponding hinge to a spring-type component. In German Utility Model No. U. 1,997,712 the position of opening or closing of the clip depends on the position of the central hinge.

This is not the case in the embodiment according to the present invention.

European Patent Application No. A 0,075,761 describes and illustrates a clip made of plastic in one piece. The clip comprises two arms equipped with reinforcements. The two arms are joined by a hinge. On the upper part of each arm two separating parts are provided which cooperate through the intermediacy of three hinges, on the one hand with the said upper parts of the arms and, on the other hand, with each other. According to the position of the two separating parts, the two arms are open or closed. There is no spring component as such.

French Pat. No. A 1,473,457 also describes and illustrates a clip made of plastic in one piece. This clip comprises only three hinges and is not equipped with swivelling, crescent-shaped components. The jaws do swivel between two positions to hold the object to be suspended but are not the parts which serve to define and to determine the position of two other parts. Furthermore, they do not cooperate with an elastic component.

GENERAL DESCRIPTION OF THE INVENTION

According to the present invention there is provided a clip made of plastic, in one piece, consisting of two articulated arms one of the ends of which serves as jaws and the other end as a lever arm, and of an upper elastic component forming a spring, which comprises, between the two arms and the elastic component, two swivelling, crescent-shaped components for opening and closing the clip, which are united by a hinge and joined both to the ends and to the elastic component by two groups of corresponding hinges.

According to a feature of the present invention the two groups of corresponding hinges are in the form of strips.

According to another feature of the present invention the jaws of the arms comprise hollows and humps forming a zigzag obstacle in the closed position.

Finally, according to another feature of the present invention the jaws of the arms comprise humps and hollows facing each other in the closed position.

BRIEF DESCRIPTION OF THE DRAWINGS

The invention will be better understood with the aid of the description and the attached drawings in which.

DETAILED DESCRIPTION

Figure 1:
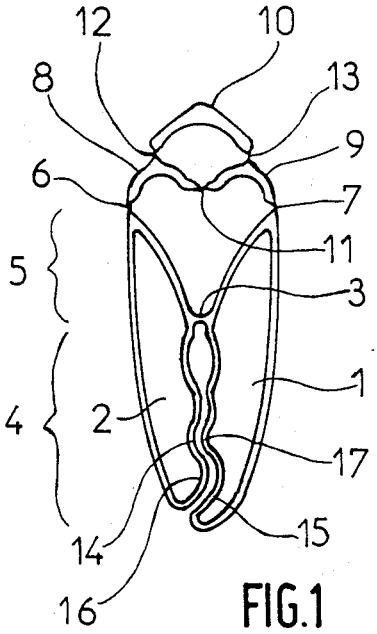
FIG. 1 shows the clip in a closed position.
Figure 2:
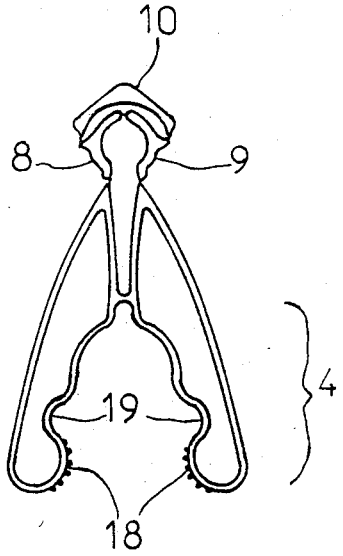
FIG. 2 shows the clip in an open position, according to one embodiment of the jaws.

The clip shown in FIG. 1 comprises two arms 1 and 2, joined by a central hinge 3 in the form of a thin plastic strip. Each arm comprises a part 4 serving as jaws and a part 5 serving as a lever arm; these two parts are arranged on either side of the central hinge 3. The arms 1 and 2 are joined by means of the hinges 6 and 7 to the components 8 and 9 which ensure, jointly with the component 10, the maintenance of the clip in an open or closed position. The components 8 and 9 are united by a hinge 11, and they swivel under the action of a pressure on the lever arms 5 or the jaws 4. The components 8 and 9 have the shape of a crescent or a circular arc, with the back outwards, and are joined, substantially in the middle of the back, to the component 10 through the intermediacy of the hinges 12 and 13 in the form of a thin plastic strip. The component 10, also in the shape of a crescent or a circular arc, is elastic and functions as a spring to permit the swivelling components 8 and 9 to pivot around the hinges 12 and 13. The elasticity of the component 10 permits a change in the interaxial distance of the hinges 12 and 13 when the components 8 and 9, under the action of a pressure on the lever arms 5, pivot around the hinges 12 and 13 and swivel to cause the clip to pass from the stable closed position to the stable open position (FIG. 2). In this stable open position the united parts of the swivelling components 8 and 9 joined by the hinge 11 register in the crescent hollow of the elastic component 10. To cause the clip to pass from the stable open position to the stable closed position it is sufficient to press the jaws 4.

The swivelling components 8 and 9 can be more or less rigid, according to their thickness, and can contribute to the production of a higher or lower pressure in the region of the jaws 4. The component 10, which functions as a spring, can also have a greater or lesser thickness to regulate the locking force of the jaws 4.

The clips are produced, ready for use, by injecting plastic into a mold. They can be molded either according to FIGS. 1 and 3, that is to say in a closed position, or according to FIG. 2, that is to say in an open position. In the event of the clips being molded in a closed position as shown in FIG. 1, it is intended to produce the jaws 4 with hollows 14, 15 and humps 16 and 17 to ensure a good clamping of the articles to be pinched, the hollow 15 and the hump 17 of the arm 1 fitting respectively opposite the hump 16 and the hollow 14 of the arm 2. This arrangement of hollows and humps in fact permits a zigzag obstacle to be produced between the jaws.

In the event of molding the clips in an open position, it is also possible to produce hollows and humps on the jaws 4; the humps 16 and 17 will be more pronounced to come into contact, in a closed position, with the hollows 14 and 15; it is also possible to produce conventional jaws of clothes pins, FIG. 2, that is to say with adjacent humps 18 and adjacent hollows 19 which come face to face in a closed position; the jaws are then symmetrical, like the remainder of the clip.

The clip of the invention of the clothes pin type is not limited, or course, to this application; it is also suitable for fixing various articles on displays; the sizes will be adapted to these various applications and also to the customers.

Figure 3:
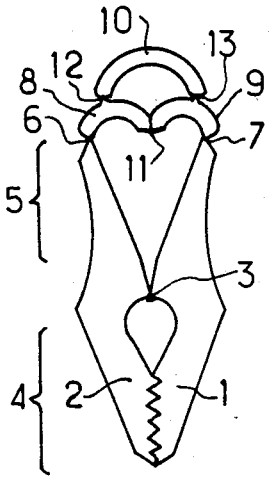
FIG. 3 shows an embodiment of the clip of the invention.

In the embodiment according to FIG. 3, the jaws 1 and 2 have a continually uniform spacing in a closed position corresponding to a minimum thickness of the products to be held. This produces a particularly noteworthy advantage which is that there is no marking of products, particularly in the rest position of the hinge-strips 8, 9, 10 which, because of this, retain their degree of elasticity with time, in contrast to the clips according to the prior art.

An advantageous feature of the clip according to the present invention lies in that, both in an open position and in a closed position, the material is neither in tension nor in compression and is not subjected to any fatigue in either of these positions. A longer life of the final product is thus obtained.

Figure 4:
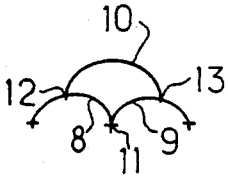
FIG. 4 illustrates in detail the closed position of the clip.
Figure 5:
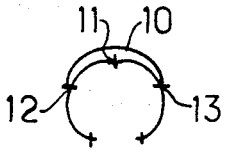
FIG. 5 illustrates in detail the open position of the clip.
Figure 6:
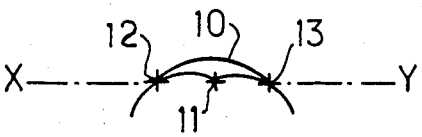
FIG. 6 shows in detail the transition from the closed position to the open position.

As illustrated in FIGS. 4, 5 and 6, the elasticity of the upper elastic component 10 comes into action only for passing from the open position (FIG. 5) into the closed position (FIG. 4) and vice versa (FIG. 6), that is to say for a very short time during which the material is not subjected to a permanent deformation.

In the embodiments of the prior art, where a spring component is provided which ensures the holding in an open position and a closed position, this component is continuously under tension, which in the long term leads to a deformation by extension of the material, sooner or later reducing the quality of the clamping.

In the present invention, the spring energy of the article or of the upper elastic component 10, provided by its being placed in extension, causes, through the intermediacy of the two swivelling components 8 and 9 which are in the shape of a crescent or a circular arc and pivot aroung the end hinges 12 and 13, the clearance of the arms 1 and 2 of the clip, the locking in an open position or in a closed position being due not to a residual effect of the upper elastic component 10 but to the position adopted by the hinge 11 respectively above or below the axis x-y (FIG. 6) passing through the hinges 12 and 13.

In the attached drawings, analogous parts bear the same reference symbols. It is readily understood that the shape of the various components can be modified without departing from the scope of the present invention.

What is claimed is:

1. A clip comprising first and second arm means pivotally connected to each other at a first hinge means located intermediate opposed ends of each arm means, a first component hingedly connected to an end of said first arm means, a second component hingedly connected to an end of said second arm means, wherein said first and second components are hingedly connected to each other and said ends are on the ssme side of said first hinge means, and spring means connected to said first component by a second hinge means and connected to said second component by a third hinge means, wherein said spring means maintains said first and second arm means in two stable conditions and wherein said spring means is in tension only when said first and second arm means are between said two stable conditions.

2. A clip according to claim 1 made by molding in a position wherein second ends of said first and second arm means are spaced from each other.

3. A clip as claimed in claim 1, wherein each of said hinge means is in the form of a strip.

4. A clip as claimed in one of claims 1 or 2, wherein jaws (4) of the arm means comprise hollows (14,15) and humps (16,17) forming a zigzag obstacle in a closed position.

5. A clip as claimed in claims 1 or 2, wherein jaws (4) of the arm means (1,2) comprise humps (18) and hollows (19) coming face to face in a closed position.

6. A clip according to claim 5 wherein said spring means is a partial cylinder concave to said first and second components and said first and second components are partial cylinders convex to said spring means.

7. A clip according to claim 6 wherein said first and second arm means, said first and second components, said spring means, and said hinge means are of plastic and are made by injecting plastic into a mold.

* * * * *